US006065373A

United States Patent [19]

Watanabe et al.

[11] Patent Number: 6,065,373

[45] Date of Patent: May 23, 2000

[54] POWER TOOL HOLDING ASSEMBLY THAT ENABLES EASIER OPERATION OF A POWER TOOL

[75] Inventors: Tsuyoshi Watanabe; Kazuyuki Ohtsuki, both of Ayabe, Japan

[73] Assignee: Nitto Seiko Co., Ltd., Kyoto, Japan

[21] Appl. No.: 09/201,747

[22] Filed: Dec. 1, 1998

[30] Foreign Application Priority Data

Sep. 28, 1998 [JP] Japan ..... 10-272666

[51] Int. Cl.[7] ..... B25B 29/00

[52] U.S. Cl. ..... 81/57.4; 81/57.24

[58] Field of Search ..... 81/57.24, 57.4, 81/426

[56] References Cited

U.S. PATENT DOCUMENTS 5,109,736 5/1992 Dixon .

5,730,034 3/1998 Hashimoto et al. ..... 81/57.4

FOREIGN PATENT DOCUMENTS 50-23436 7/1975 Japan .

3-126564 12/1991 Japan .

7-001347 1/1995 Japan .

*Primary Examiner*—James G. Smith

[57] ABSTRACT

A power tool holding assembly includes a first direction guiding unit that has a piston-cylinder construction and a linear movement guiding unit that includes a ball spline and is connected via ball bearings to a piston rod of the piston-cylinder construction so as to be freely rotatable. A power tool is mounted onto one end of the spline shaft of the linear movement guiding unit. A space inside the cylinder of the piston-cylinder construction below the piston is connected via a hose coupling and hose to an air compressor that fills the space with compressed air. The air pressure of the compressed air fed into the space is regulated by a pressure regulating valve provided on the hose and so is maintained at a value that keeps the rod stationary.

15 Claims, 9 Drawing Sheets

10
101
501a
501b
502a
502b
502c
502d
503
504
504f
504h
504s
505a
505b
505c
505d
506
507a
507b
508
509
510a
510b
511
512a
512b
513a
513b
513d
514a
514b
B
d

POWER TOOL HOLDING ASSEMBLY THAT ENABLES EASIER OPERATION OF A POWER TOOL

BACKGROUND OF THE INVENTION (1) Field of the Invention

The present invention relates to a holding assembly that holds a portable power tool, such as an electric driver that is used in the assembly of electrical appliances.

(2) Description of the Prior Art

Electrical appliances are often assembled on an assembly line by arranging personnel along a conveyor that carries goods. One task frequently performed during assembly is the tightening of screws, with power tools such as electric drivers being used to complete this task in a short time. Such electric drivers are often held by a holding assembly that may be attached to the factory ceiling, for example.

A reel-type assembly is commonly used for holding power tools. Such assembly includes a reel that is fixed at a given position, such as to the factory ceiling, and a rope that is wound around the reel. An electric driver or other power tool is attached to the rope and is usually held at a standard position above the operator's work area. To use the electric driver, the operator pulls the tool down by hand.

Reel-type holding assemblies have a disadvantage in that the electric driver is merely suspended on a rope, so that the reaction force produced by the screw tightening torque of the electric driver when the screw has been tightened needs to be countered by the operator's hands. This requires a noticeable exertion by the operator, and so can prevent an operator from continuously working for a long time.

In view of the stated problem, Japanese Laid-Open Patent Application H07-1347 teaches the power tool holding assembly shown in FIG. 1.

The holding assembly shown in FIG. 1 is a crank-type holding assembly. This holding assembly comprises a main post, a first arm that is attached to the main post so as to be freely rotatable in the horizontal plane, and a second arm that is connected to the first arm so as to be freely rotatable in the horizontal plane. This holding assembly is used with the electric driver attached to the end of the second arm. The second arm is composed of a quadric-linked construction where an extension spring is extended between opposite corners of the construction.

When performing a screw tightening operation using an electric driver supported by the above crank-type holding assembly, the operator first holds the grip of the electric driver and moves the electric driver in the horizontal plane to position it above the screw tightening position. The operator then pulls the electric driver down against the tension of the extension spring to move the driver bit to the screw tightening position, and performs the screw tightening operation. When doing so, the reaction force to the screw tightening torque of the electric driver produced when the screw has been tightened is largely absorbed by the holding assembly. This greatly reduces the exertion required of the operator.

When using a crank-type holding assembly, however, if the operator releases the driver on completing the tightening of one screw, the tension of the extension spring will pull the electric driver upward. As a result, the operator has to go to the trouble of pulling the electric driver down by a considerable distance to tighten each screw, making the screw tightening process inefficient.

Also, when the operator moves the electric driver in the horizontal plane to position it above the screw tightening position, the first arm will move in a circle about the join with the main post and the second arm in a circle about the join with the first arm. Since a combination of these circular movements determines the trajectory of the electric driver, the operator can move the electric driver with great freedom. Accordingly, when moving the electric driver to the intended position, the operator will try to use the shortest possible course. This means the operator will attempt to move the electric driver directly to the intended position.

As described above, however, linear movement of the electric driver involves circular motion of the first and second arms. This means that the direction moved by the electric driver does not correspond to the directions moved by the first and second arms. Inertia in the first and second arms affects the movement of the electric driver, and the directions in which inertia acts in the first and second arms can differ to the direction of movement of the electric driver. This means that the operator can find the power tool being pulled in an unintended direction. Such unintended movement prevents the operator from quickly and correctly positioning the power tool at the required position.

SUMMARY OF THE INVENTION

It is a first object of the present invention to provide a power tool holding assembly that enables an operator to repeatedly make use of a power tool without having to move the tool a considerable distance in the vertical direction.

It is a second object of the present invention to provide a power tool holding assembly that enables the operator to quickly and correctly position a power tool at an intended spot.

The first object of the present invention can be achieved by a power tool holding assembly that supports a power tool and allows an operator to move the power tool to a desired position in three-dimensional space where the power tool is to be used, the power tool being a tool that performs a job on being given a driving force, the power tool holding assembly including: a first direction guiding unit for guiding movement of the power tool in a first direction and for holding the power tool stationary at a desired height due to pressure applied by a fluid that is introduced into the first direction guiding unit from outside; an intersecting plane guiding unit which is connected in series to the first direction guiding unit and guides movement of the power tool in a plane that intersects the first direction; and a power tool mounting unit for mounting the power tool onto one of the first direction guiding unit and the intersecting plane guiding unit.

The first object of the present invention can also be achieved by a power tool holding assembly that supports a power tool and allows an operator to move the power tool to a desired position in three-dimensional space where the power tool is to be used, the power tool being a tool that performs a job on being given a driving force, the power tool holding assembly including: a first movement guiding member which has a moving end and guides movement of the moving end in a direction in which gravity acts; a second movement guiding member which has a moving end and guides movement of the moving end in a plane that intersects the direction in which gravity acts; a linking member for connecting a moving end of one guiding member, out of the first movement guiding member and the second movement guiding member, to another guiding member, out of the first movement guiding member and the second movement guiding member; a power tool mounting member which is attached to the moving end of the other guiding member and sets the power tool onto the other guiding member; and a load canceling unit for applying lift to the first movement guiding member to counter a weight load applied by the moving end of the first movement guiding member and so keep the moving end of the first movement guiding member stationary at a desired position.

The second object of the present invention can be achieved by a power tool holding assembly where a intersecting plane guiding unit includes: a first guiding part that guides a first movement of the power tool; and a second guiding part that guides a second movement of the power tool that differs from the first movement.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

The following is a description of an embodiment of the power tool holding assembly of the present invention, with reference to the drawings.

Figure 1:
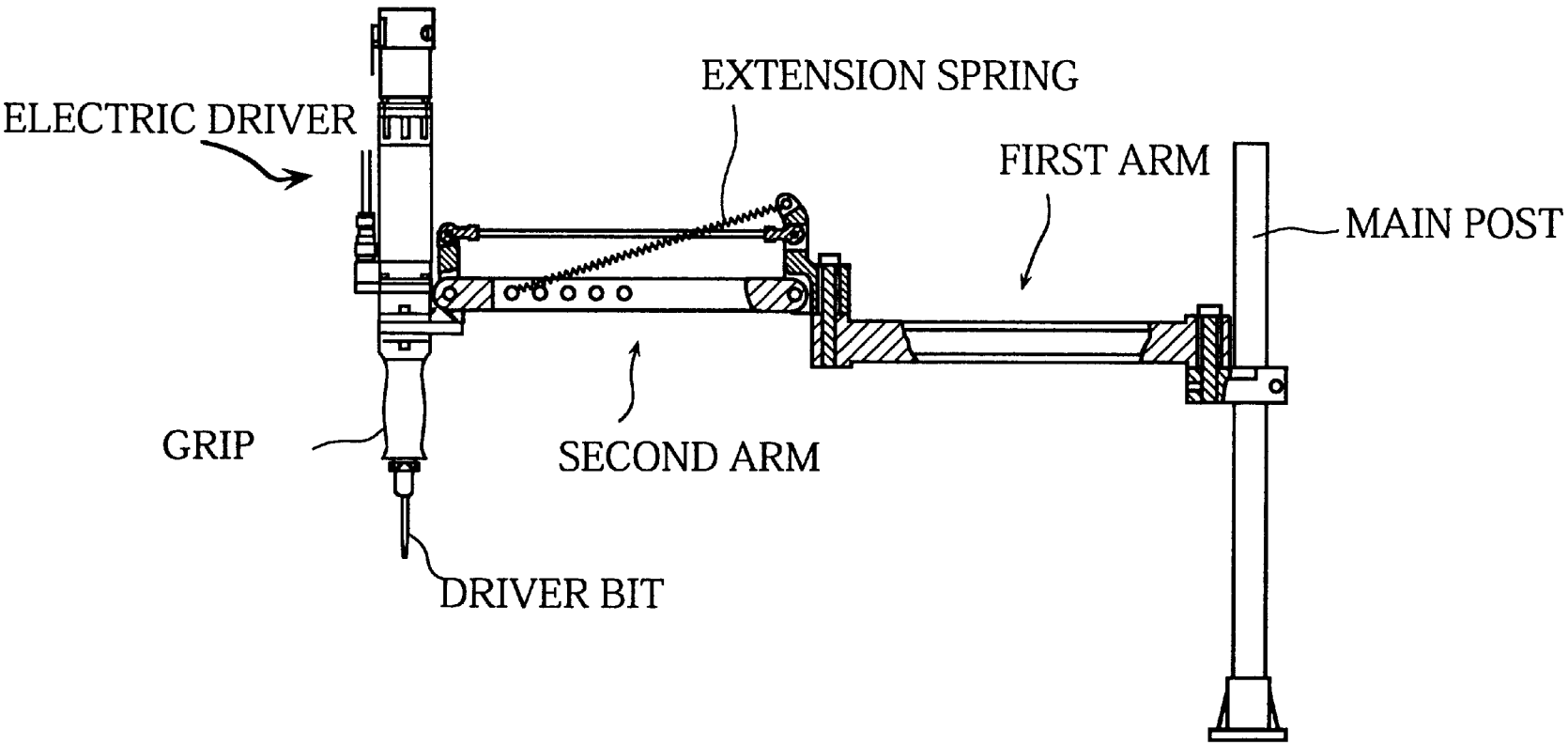
FIG. 1 RELATED ART
FIG. 1 shows a conventional power tool holding assembly.
Figure 2:
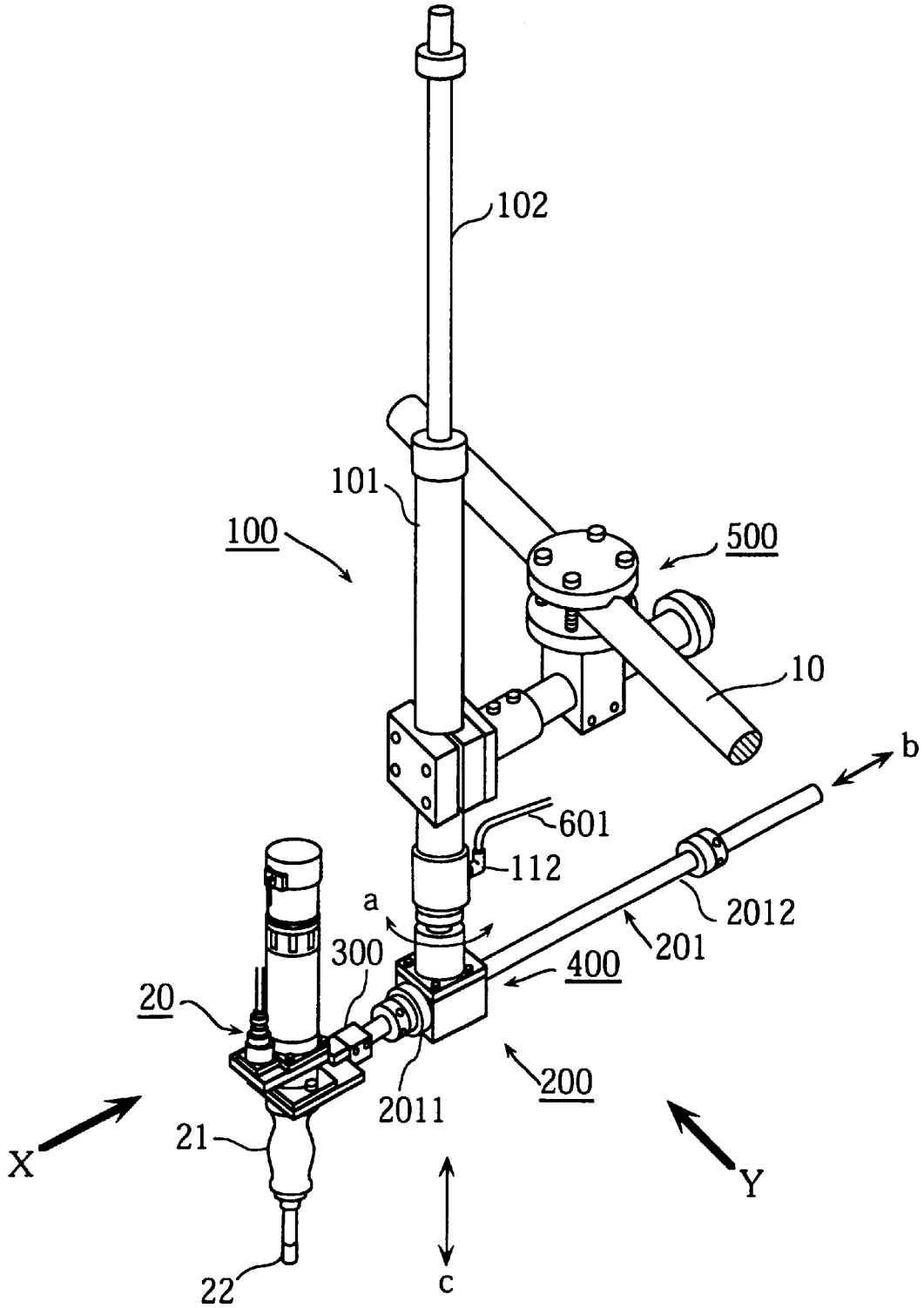
FIG. 2 is a perspective drawing of the simplified construction of the power tool holding assembly of an embodiment of the present invention, with an electric driver having been attached to the power tool holding assembly and the power tool holding assembly having been secured to a pipe.
Figure 3:
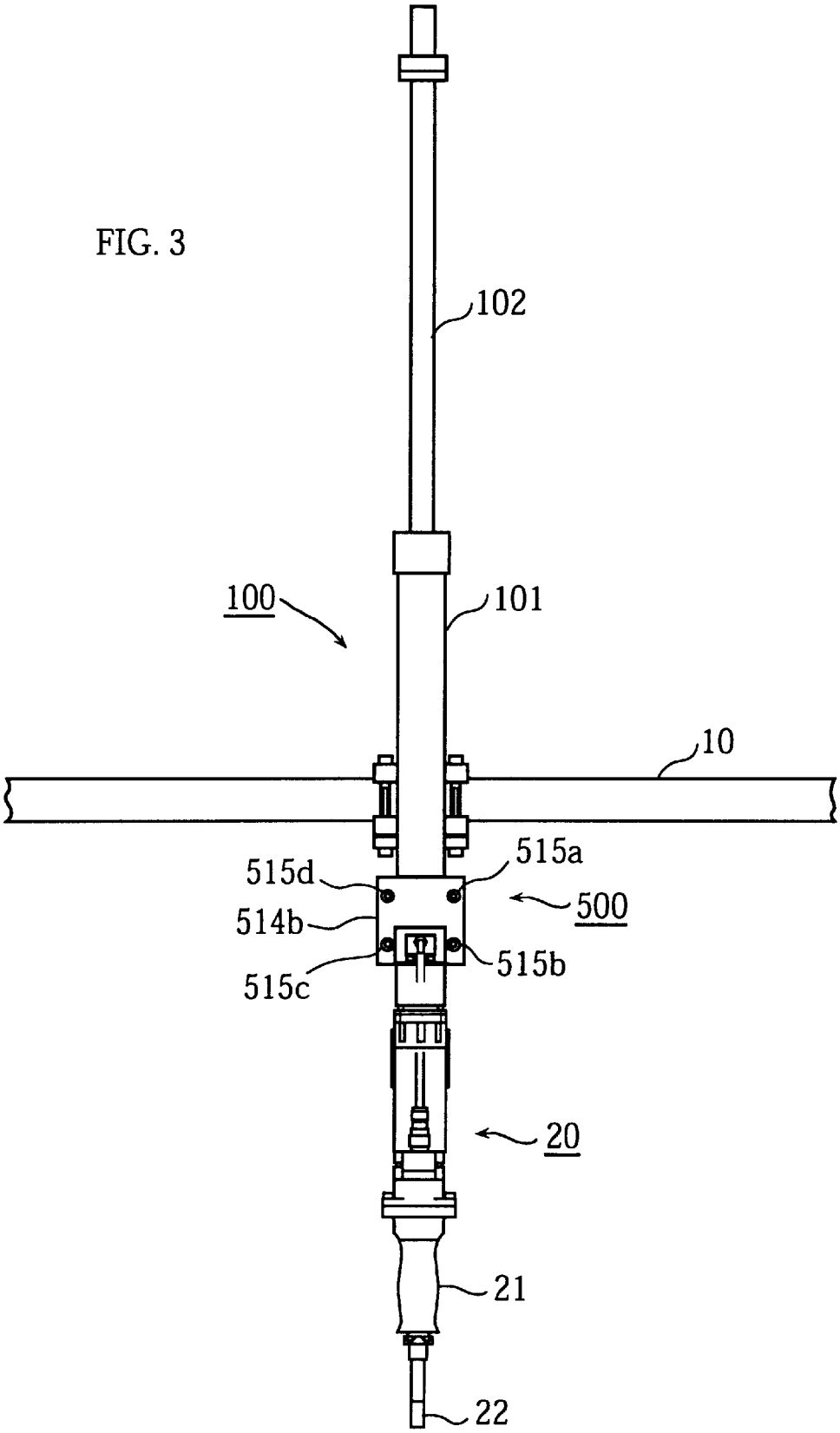
FIG. 3 is an elevation of the power tool holding assembly in the direction shown by the arrow X in FIG. 2.
Figure 4:
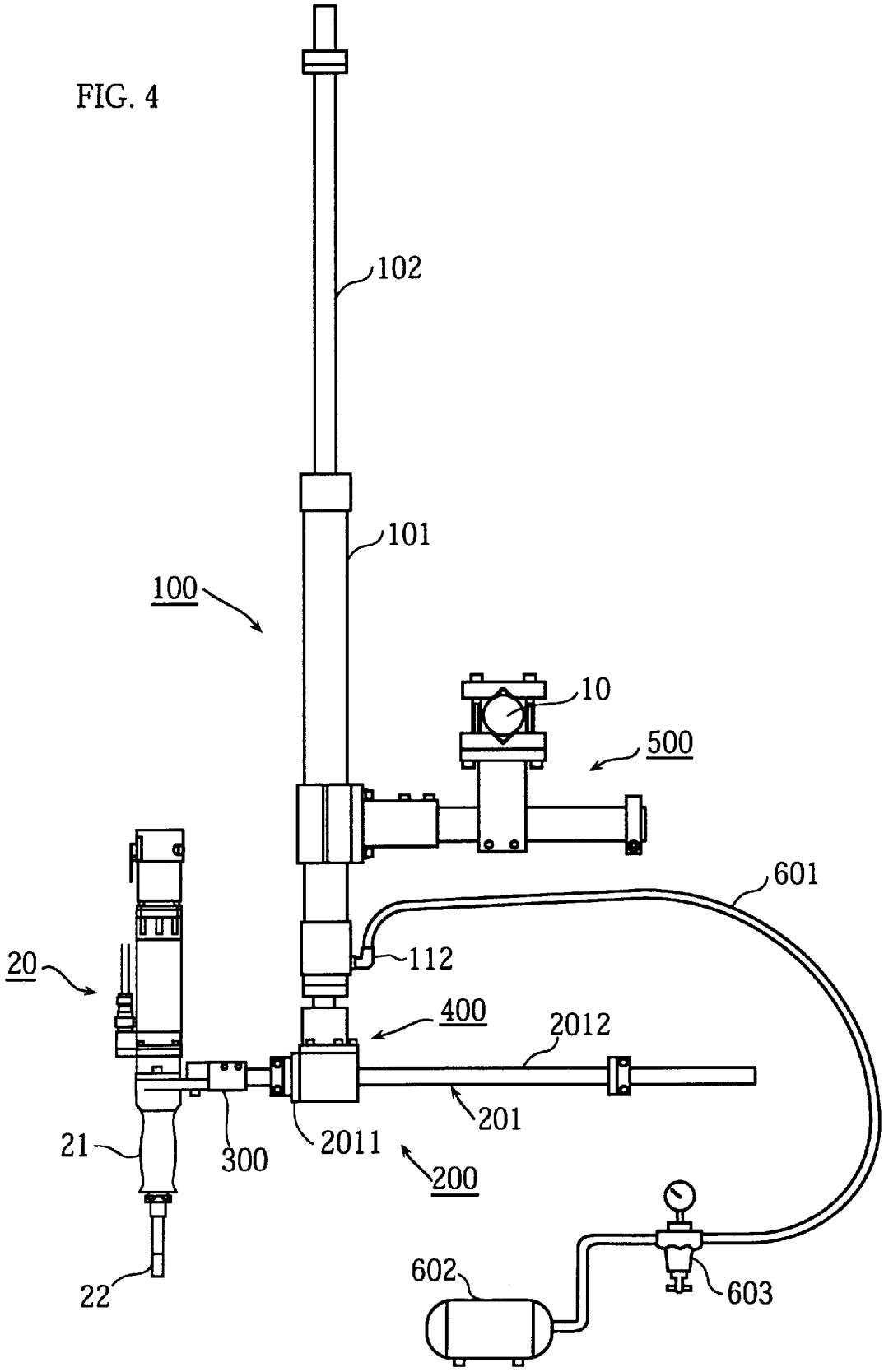
FIG. 4 is an elevation of the power tool holding assembly in the direction shown by the arrow Y in FIG. 2.

FIG. 2 is a perspective drawing of the simplified construction of the power tool holding assembly of an embodiment of the present invention. FIG. 3 is an elevation of the power tool holding assembly in the direction shown by the arrow X in FIG. 2. FIG. 4 is an elevation in the direction shown by the arrow Y.

The present power tool holding assembly is used having been attached to a construction such as the pipe 10. The power tool holding assembly comprises a vertical guiding means 100, a linear movement guiding means 200, a tool mounting member 300, a guiding means linking part 400, and a fixing member 500. The vertical guiding means 100 includes the cylinder 101 and the rod 102. The linear movement guiding means 200 includes the ball spline 201. The tool mounting member 300 attaches a portable power tool like the electric driver 20. The guiding means linking part 400 links the vertical guiding means 100 and the linear movement guiding means 200. The fixing member 500 attaches the vertical guiding means 100 to the pipe 10.

Figure 5:
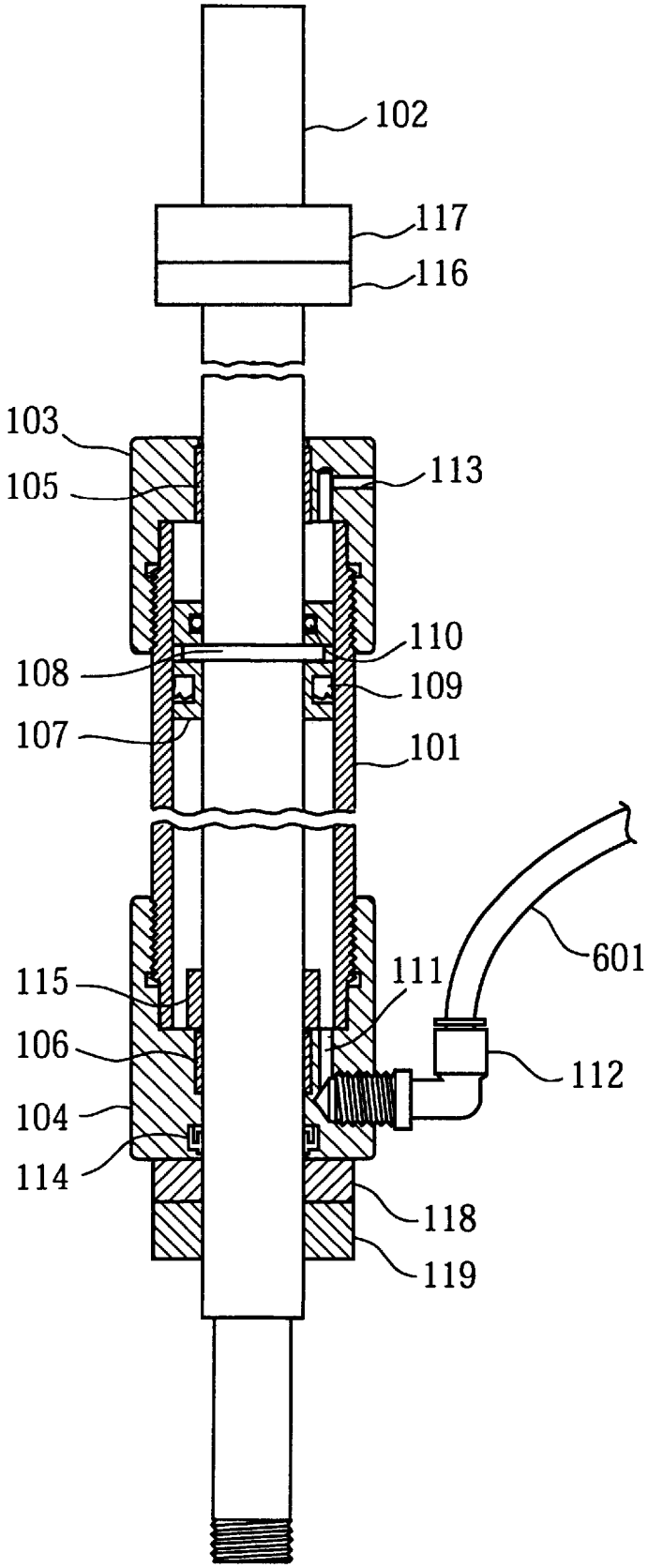
FIG. 5 is a vertical cross-section of the vertical guiding means.

FIG. 5 is a vertical cross-section of the vertical guiding means 100.

As shown in the drawing, the cylinder covers 103 and 104 are respectively screwed onto the top and bottom parts of the cylinder 101. These cylinder covers 103 and 104 are supported via the slide bearings 105 and 106 so that the rod 102 is freely slidable in the axial direction of the cylinder 101.

The rod 102 is inserted into the piston 107 that is attached to the rod 102 by the parallel pin 108. The piston 107 is also provided with the packing material 109 and the O ring 110. The packing material 109 keeps the piston 107 in airtight contact with the inner surface of the cylinder 101. The O ring 110 keeps the piston 107 in airtight contact with the rod 102.

An air introduction aperture 111 that passes horizontally and vertically through the cylinder cover 104 is also provided. The hose coupling 112 is screwed into the horizontal part of the air introduction aperture 111. The hose 601 that is set on the hose coupling 112 is attached to an air compressor 602 (see FIG. 4). Compressed air outputted by the air compressor 602 is introduced into the cylinder 101 via the hose 601, the hose coupling 112, and the air introduction aperture 111.

A pressure regulating valve 603 (see FIG. 4) is provided on the hose 601 between the air compressor 602 and the hose coupling 112. This pressure regulating valve 603 is a well-known component which ensures that compressed air of a specified pressure is supplied to the part of the cylinder 101 that is below the piston 107. The pressure regulating valve 603 is a relief-type valve, so that when the air pressure inside the cylinder 101 exceeds the specified pressure, the pressure regulating valve 603 automatically allows air in the cylinder side of the hose 601 to escape. This maintains the specified pressure in the cylinder 101. The value of this specified pressure is described later in the specification.

An air hole 113 is provided in the cylinder cover 103 to ensure that the space inside the cylinder 101 above the piston 107 is at atmospheric pressure.

To ensure the join between the cylinder cover 104 and the cylinder 101 is airtight, sealing tape (not illustrated) is first wound around the surface of the lower threaded part of the cylinder 101 before the cylinder cover 104 is screwed onto the thread. The packing material 114, meanwhile, ensures that the cylinder cover 104 is kept in airtight contact with the surface of the rod 102.

The rod 102 is inserted into the sleeve-like cylinder cushion 115 that absorbs shocks caused at the lower stroke end of the rod 102.

The cushion 116 is held on the rod 102 by the set collar 117 at a position above the cylinder cover 103. The cushion 116 can be fixed to the rod 102 at any position in the axial direction to enable an operator to adjust the position of the lower stroke end of the rod 102. When the position of the lower stroke end has been determined by the cushion 116, if the cushion 116 comes into contact with the cylinder cover 103 before the piston 107 comes into contact with the cylinder cushion 115, the cushion 116 will act as a shock absorber.

The cushion 118 is held on the rod 102 by the set collar 119 at a position below the cylinder cover 104. This cushion 118 enables an operator to adjust the position of the upper stroke end of the rod 102, and absorbs shocks at the upper stroke end of the rod 102.

By changing the positions at which the cushion 116 and the cushion 118 are attached, the operator can change the slide range and slide stroke of the rod 102 with respect to the cylinder 101.

Note that while the above example describes a case where the rod 102 and piston 107 are separate components, an integrated structure may be used.

Figure 6:
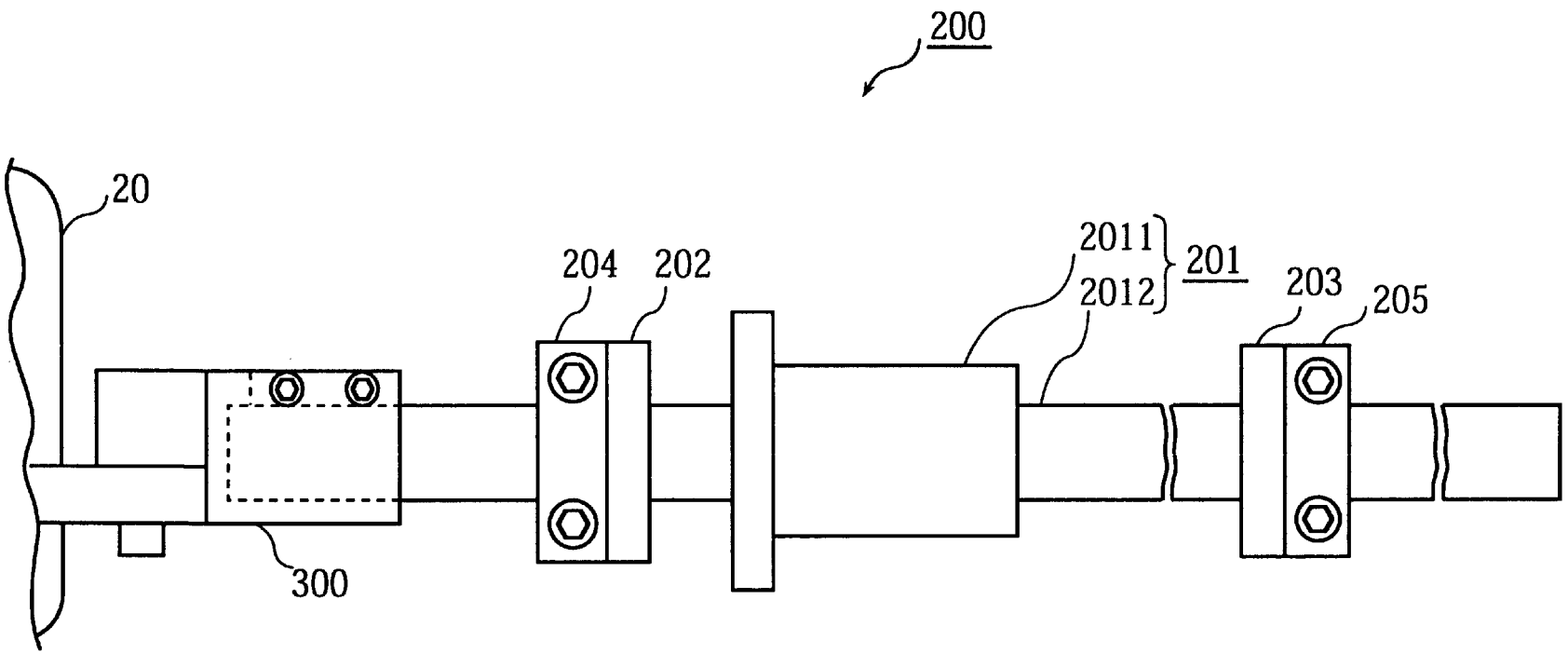
FIG. 6 shows the linear movement guiding means.

FIG. 6 shows the linear movement guiding means 200.

The linear movement guiding means 200 includes a conventional radial-type ball spline 201 (hereinafter, "ball spline 201") that comprises a flange-type sleeve (hereinafter, "sleeve") 2011 and a spline shaft 2012. Set collars 204 and 205 hold the cushions 202 and 203 on the spline shaft 2012 on respective sides of the sleeve 2011. Like the cushions 116 and 118, the cushions 202 and 203 can be fixed anywhere along the axis of the spline shaft 2012, with the operator being able to adjust the slide range and slide stroke of the spline shaft 2012 with respect to the sleeve 2011 by changing the positions at which the cushions 202 and 203 are fixed. These cushions 202 and 203 act as shock absorbers at both stroke ends of the spline shaft 2012, in the same way as the cushions 116 and 118.

The electric driver 20 is attached to one end of the spline shaft 2012 via the tool mounting member 300.

It should be noted here that since the ball spline 201 is attached to the rod 102 with the spline shaft 2012 perfectly horizontal, there is no risk of the spline shaft 2012 sliding on its own.

Figure 7A:
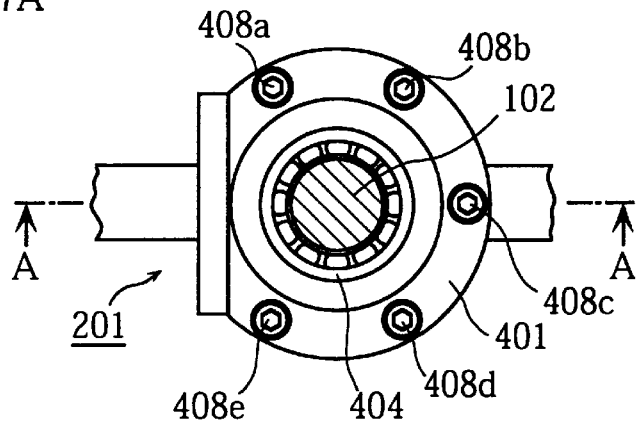
FIG. 7A shows an overhead view of the guide means linking part.
Figure 7C:
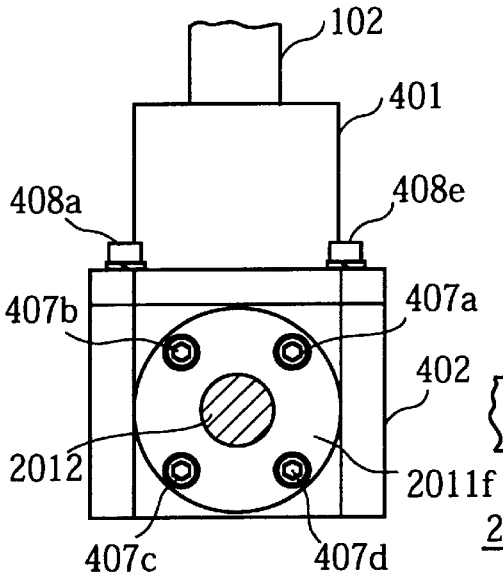
FIG. 7C shows a side view of the guide means linking part shown in FIG. 7A.
Figure 7B:
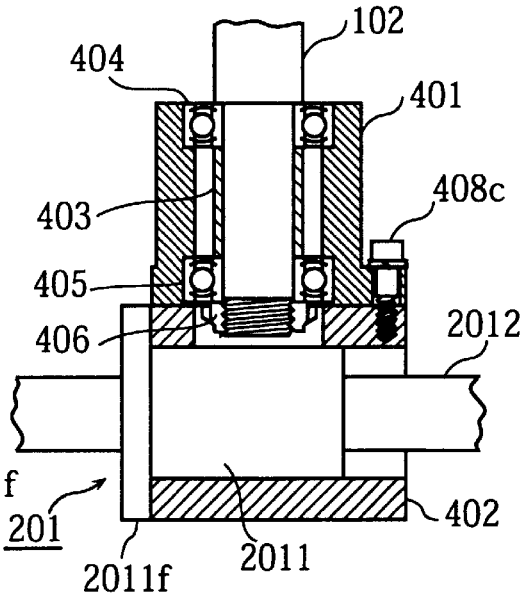
FIG. 7B shows a cross-section of the guide means linking part taken along the line A—A shown in FIG. 7A.

FIGS. 7A to 7C show the construction of the guide means linking part 400, with FIG. 7A being an overhead view, FIG. 7B being a cross section of FIG. 7A taken along the line A—A, and FIG. 7C being a left-side elevation.

The guide means linking part 400 includes a housing 401 that is attached to the rod 102 of the vertical guiding means 100 and a housing 402 that is attached to the sleeve 2011 of the linear movement guiding means 200.

As shown in FIG. 7B, the deep-groove ball bearings (hereinafter, "ball bearings") 404 and 405 are press-fitted on either side of the collar 403 at the counterbore parts at the top and bottom of the housing 401. The narrow-diameter part at the bottom end of the rod 102 is inserted into the collar 403 and ball bearings 404 and 405.

A screw thread is formed in the narrow-diameter part of the rod 102 to engage the nut 406. This nut 406 has an appropriate size so that only the bearing surface comes into contact with the inner ring of the ball bearings 405. The rod 102 is also manufactured with suitable dimensions so that the side surface of the step where the narrow-diameter part meets the wide-diameter part only touches the inner ring of the ball bearings 404. As a result, attaching the nut 406 results in the nut 406, the inner ring of the ball bearings 405, and the rod 102 being connected to form an integral body. This means that the housing 401 is held onto the rod 102 whereby it is free to rotate about the center axis of the rod 102.

The collar 403 is manufactured with almost the same thickness as the inner rings of the ball bearings 404 and 405, and almost the same length as the distance between the upper and lower counterbore parts to prevent damage to the ball bearings 404 and 405 when the nut 406 is tightened. Putting this another way, the collar 403 ensures that the nut 406 can be tightened with sufficient torque. Note that a conventional self-locking nut is used as the nut 406.

The sleeve 2011 of the ball spline 201 is inserted into the housing 402, and the flange part 2011f of the sleeve 2011 is attached to the housing 402 by means of the four hexagon socket head cap screws 407*a*, 407*b*, 407*c*, and 407*d*, as shown in FIG. 7C.

In the same way, the housing 401 and the housing 402 are attached using five hexagon socket head cap screws 408*a*, 408*b*, 408*c*, 408*d*, and 408*e*. As a result, the linear movement guiding means 200 is attached to the vertical guiding means 100 so as to be free to rotate about the center axis of the rod 102 in the vertical guiding means 100.

As described above, the guide means linking part 400 acts as a rotation holding unit that holds the linear movement guiding means 200 and allows free rotation about the center axis of the rod 102. In combination with the linear movement guiding means 200, the guiding means linking part 400 acts as horizontal guiding unit that allows the object attached to the linear movement guiding means 200 (in the present example, the electric driver 20) to be moved in the horizontal plane.

Figures 8A, 8B, 8C, 8D:
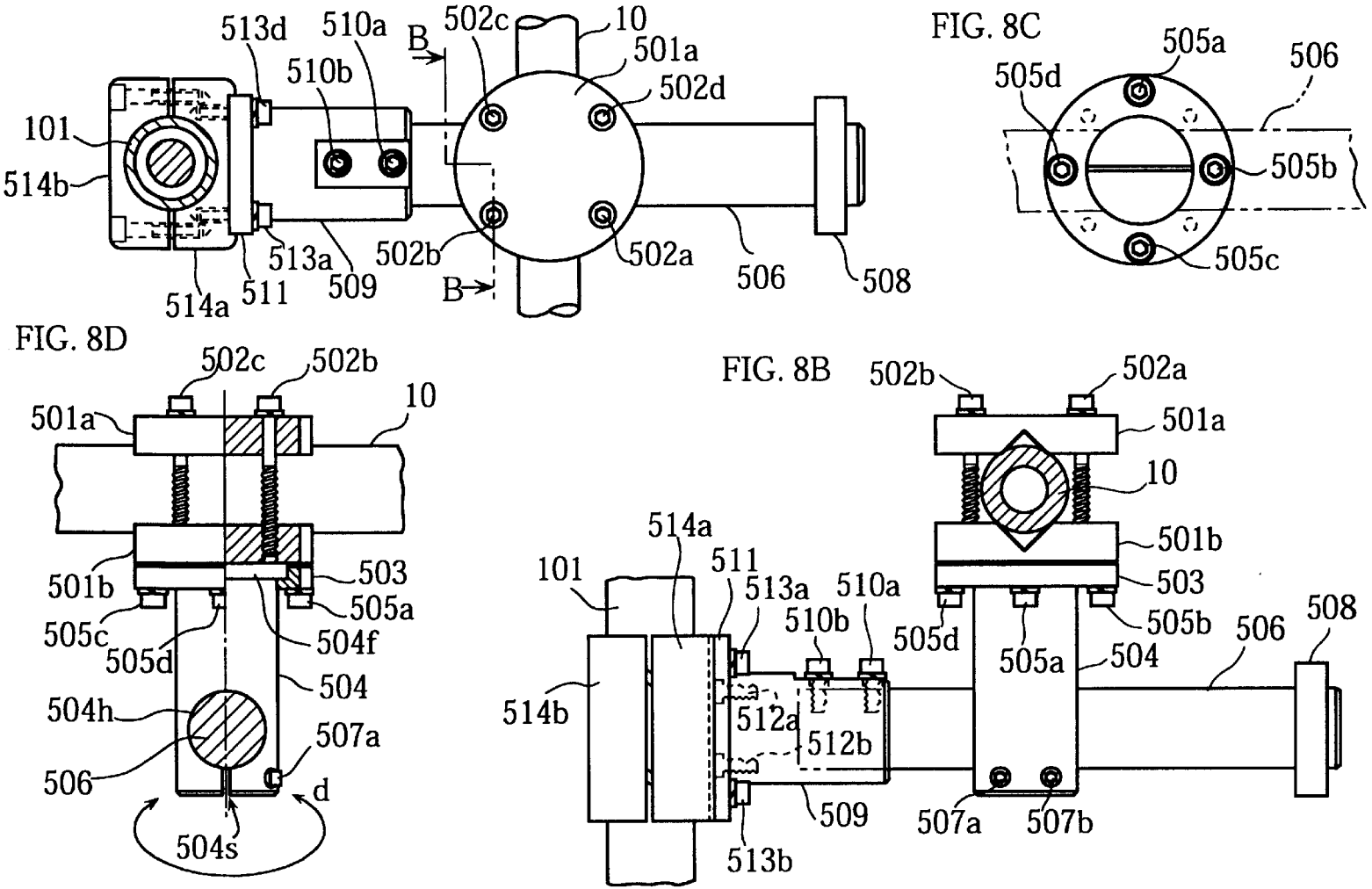
FIG. 8A is an overhead view of the fixing member.
FIG. 8B is a front elevation of the fixing member.
FIG. 8C shows the fixing member from below.
FIG. 8D shows a partial cross-section of FIG. 8B taken along the line B—B.

FIGS. 8A to 8D show the construction of the fixing member 500 that fixes the cylinder 101 to the pipe 10. FIG. 8A is an overhead view, FIG. 8B is a front elevation, FIG. 8C shows the fixing member 500 from below, and FIG. 8D shows a partial cross-section of FIG. 8B taken along the line B—B.

The following is a description of the components of the fixing member 500, starting with the side closest to the pipe 10.

The pipe 10 is held between a pair of pipe clamping members 501*a* and 501*b* that are disc-like in form and each have a V-shaped groove in one side. With the pipe 10 held between them, the pipe clamping members 501*a* and 501*b* are fixed to one another by means of the four hexagon socket head cap screws 501*a*, 501*b*, 501*c*, and 501*d*.

As shown in FIG. 8B, the formation of the V-shaped grooves in the pipe clamping members 501*a*, 501*b* means that the fixing member 500 can be clamped to a range of different pipe sizes. Also, after fixing the pipe clamping members 501*a*, 501*b* at a given position, it is possible to slightly loosen the screws 502*a* to 502*d* and then slide the pipe clamping members 501*a*, 501*b* along the pipe 10, meaning that the position of the power tool holding assembly can easily be changed.

The pipe clamping member 501*b* is attached to the angle adjustment shaft 504 by the fixed ring 503. This angle adjustment shaft 504 is cylindrical in form and, as shown in FIG. 8D, has a flange 504*f* formed at one end. The fixed ring 503, meanwhile, is shaped as a ring with a step formed in its inner circumference so that it has both a "large" and "small" inner circumference.

The fixed ring 503 engages the angle adjustment shaft 504 with the orientation shown in FIG. 8D, and is fixed to the pipe clamping member 501*b* by means of four hexagon socket head cap screws 505*a*, 505*b*, 505*c*, 505*d*. These screws 505*a* to 505*d* can be first loosely tightened to allow the operator to rotate the angle adjustment shaft 504 in the direction d to a desired angle.

Once the desired angle has been found, the screws 505*a* to 505*d* are properly tightened. Since the inner face of the large inner diameter part of the fixed ring 503 is not as tall as the thickness of the flange 504*f*, the bottom side of the flange 504*f* of the angle adjustment shaft 504 is firmly pressed against the pipe clamping member 501*b*. This results in the angle adjustment shaft 504 being attached to the pipe clamping member 501*b* without being able to rotate. After attaching the angle adjustment shaft 504, however, loosening the screws 505*a* to 505*d* enables the angle adjustment shaft 504 to be rotated, so that the operator can easily change the angle at which the angle adjustment shaft 504 is fixed.

As shown in FIG. 8D, the angle adjustment shaft 504 has a through hole 504*h* formed perpendicular to its axis at the opposite end to the flange 504*f*. The offset adjustment shaft 506, which is formed as a cylinder with almost the same diameter as the through hole 504*h*, is inserted into the through hole 504*h*. A slit 504*s* is provided at the lower end of the angle adjustment shaft 504, with the hexagon socket head cap screws 507*a* and 507*b* being tightened to close this slit 504*s* and so fix the inserted offset adjustment shaft 506 to the angle adjustment shaft 504.

By adjusting the position of the offset adjustment shaft 506 on the angle adjustment shaft 504 that is in turn attached to the pipe 10, the operator can adjust the clearance of the vertical guiding means 100, attached to the end of the offset adjustment shaft 506, from the pipe 10, which in turn changes the clearance of the electric driver 20. A stopper collar 508 is provided on one end of the offset adjustment shaft 506 to prevent the offset adjustment shaft 506 from falling off the angle adjustment shaft 504 when performing such adjustment.

A connecting arm 509 is provided on the other end of the offset adjustment shaft 506 to the stopper collar 508. This connecting arm 509 is slid onto the end of the offset adjustment shaft 506 and is secured to the offset adjustment shaft 506 by the hexagon socket head cap screws 510*a*, 510*b* that are inserted into the screw hole in the connecting arm 509 and are screwed into two threaded holes provided in the offset adjustment shaft 506.

A connecting plate 511 is attached to the connecting arm 509 by means of two hexagon socket head cap screws 5 12*a*, 512*b*. The cylinder clamping member 514*a* is attached to this connecting plate 511 by means of four hexagon socket head cap screws 513*a*, 513*b*, 513*c*, and 513*d*, of which screw 513*c* is not illustrated. An opposing cylinder clamping member 514*b* is attached to the cylinder clamping member 514*a* by means of the four hexagon socket head cap screws 515*a*, 515*b*, 515*c*, and 515*d* (as shown in FIG. 3), with the cylinder 101 being firmly held between the cylinder clamping members 514*a* and 514*b*.

After fixing the cylinder 101, the operator can still loosen the screws 515*a* to 515*d* to allow the cylinder 101 to slide between the cylinder clamping members 514*a* and 514*b*. In this way, the operator can easily adjust the position at which the cylinder 101 is held.

In the present example, the pipe 10 that is used to secure the power tool holding assembly is an ordinary pipe that runs parallel to the ceiling. Such pipes are commonly found in factories, though the present power tool holding assembly does not need to be secured to such a pipe. It should be obvious that the form of the fixing member 500 and the other components can be changed in accordance with the way in which the power tool holding assembly is secured.

Returning to FIG. 4, the electric driver 20 is attached to the power tool holding assembly described above, and the value of the air pressure introduced from outside (specifically by the air compressor 602) via the hose coupling 112 is maintained by the operation of the pressure regulating valve 603, as described below.

The value of the air pressure is set so that the guided structure (including the guide means linking part 400, the linear movement guiding means 200, the tool mounting member 300, and the electric driver 20) that is guided by the vertical guiding means 100 comes to rest at a desired point in the stroke of the rod 102. At such a point, the upward force on the rod 102 due to the action of the air pressure introduced into the cylinder 101 on the piston 107 (see FIG. 5) is in equilibrium with the weight of the guided structure.

The operator performs screw tightening operations with the electric driver 20 attached to the power tool holding assembly while the air pressure in the cylinder 101 is regulated by the pressure regulating valve 603. Returning to FIG. 2, the operator takes the electric driver 20 by the grip 21 and moves the electric driver 20 in the horizontal plane to a position where the driver bit 22 is directly above the screw tightening position.

When moving the electric driver 20, the operator first rotates the linear movement guiding means 200 about the vertical guiding means 100 until the axis of the linear movement guiding means 200 is aligned with the screw tightening position. The direction of this movement is shown by the arrow a in FIG. 2.

Next, the operator pulls the electric driver 20 away from the vertical guiding means 100 in the direction b to bring the driver bit 22 to a position directly above the screw tightening position. As a result, the spline shaft 2012 of the linear movement guiding means 200 slides through the sleeve 2011.

For the power tool holding assembly of the present embodiment, the direction moved by the electric driver 20 in the horizontal plane is determined by a combination of the rotation of the guide means linking part 400 and the unrelated linear movement of the linear movement guiding means 200. As a result, when using this power tool holding assembly, the operator moves the electric driver 20 with a first operation (movement) before moving the electric driver 20 with a second operation (movement).

With the present construction, although inertia acts on various components when the operator moves the electric driver 20, this inertia acts in the same direction as the movement of the electric driver 20 and so does not cause the electric driver 20 to move in a direction that is unintended by the operator. This means that the operator can quickly and easily move the electric driver 20 to the desired position.

Having moved the electric driver 20 to the desired position, the operator pulls the electric driver 20 downward (the direction shown by the arrow c in FIG. 2) so that the tip of the driver bit 22 reaches the screw tightening position, and performs the screw tightening operation.

Once the screw has been tightened, the majority of the reaction force produced by the screw tightening torque will be absorbed by the power tool holding assembly, so that the load of the operator is considerably less than when the electric driver 20 was conventionally supported only by the operator's hands.

Once the operator releases the electric driver 20, the vertical guiding means 100 acts to keep the electric driver 20 at the released position, and so does not move the electric driver 20 in the vertical plane. This means that the operator can keep the electric driver 20 at a convenient height in readiness for the next screw tightening operation, which improves the efficiency of screw tightening operations.

While the present invention has been explained by means of the above embodiment, the invention is obviously not limited to the specific details given in this specification. Example modifications are described below.

(1) In the above embodiment, the vertical guiding means 100 is first attached to the pipe 10, with the linear movement guiding means 200 being attached to the vertical guiding means 100 by the guiding means linking part 400 so as to be free to rotate. The electric driver 20 is attached to the spline shaft 2012 of the linear movement guiding means 200 via the tool mounting member 300. However, these components do not need to be linked in this order.

As one example, the linear movement guiding means 200 may be attached to the pipe 10 so as to be free to rotate. The cylinder 101 of the vertical guiding means 100 may then be attached to the end of the spline shaft 2012 of the linear movement guiding means 200, and the electric driver 20 may be attached to the lower part of the rod 102 of the vertical guiding means 100. When doing so, it should be obvious that the linking parts that link the components may be changed as necessary. In such a case, only the electric driver 20 is guided by the vertical guiding means 100.

Figure 9:
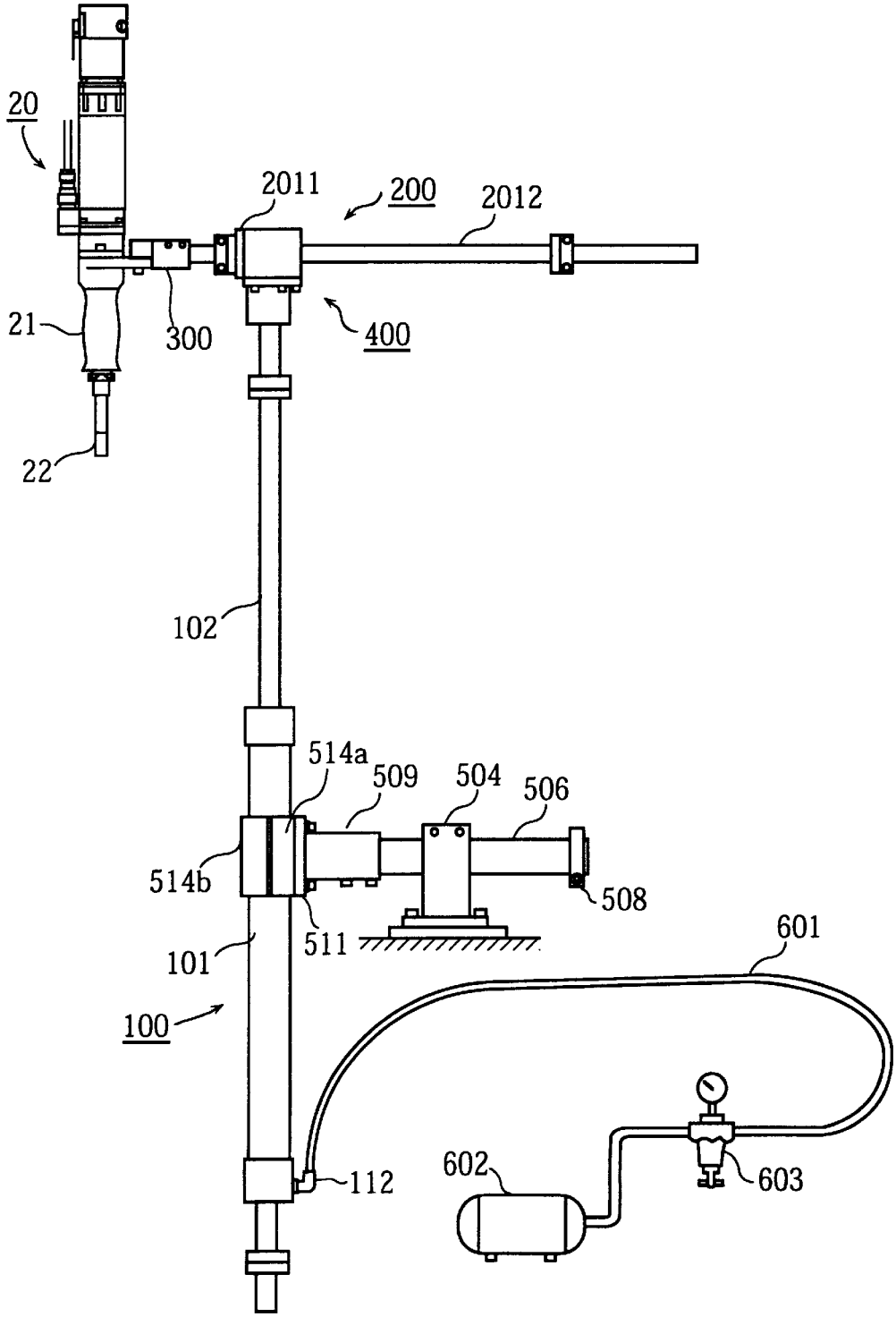
FIG. 9 shows an alternative embodiment of the present invention.

(2) In the above embodiment, the power tool holding assembly is secured to a pipe positioned above the operator's work area, with the electric driver 20 being (indirectly) attached to the bottom end of the rod 102 of the vertical guiding means 100. However, as shown in FIG. 9, the power tool holding assembly may be secured to a corner of the operator's workbench, with the electric driver 20 being (indirectly) attached to the top end of the rod 102 of the vertical guiding means 100. Note that the power tool holding assembly shown in FIG. 9 is merely a rearrangement of the components described in the embodiment, with only partial changes having been made to the fixing member 500.

(3) In the above embodiment, the vertical guiding means 100 extends vertically as its name would suggest. However, not all screws need to be tightened in the vertical direction, so that it is possible for this vertical guiding means 100 to be fixed with the axis of its rod 102 in an inclined position. This can be realized by adjusting the angle at which the pipe clamping members 501*a* and 501*b* clamp the circumference of the pipe 10, and by adjusting the angle at which the angle adjustment shaft 504 is attached with respect to the direction of the pipe 10. By doing so, the orientation of the vertical guiding means 100 can be aligned with the axis of the threaded holes into which the screws are to be inserted.

(4) In the above embodiment, an electric driver is given as an example of a tool to be attached to the power tool holding assembly, although other kinds of power tools may obviously be used for the present power tool holding assembly. As examples, an air driver, and electric riveter, or an air riveter may be used.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A power tool holding assembly that supports a power tool and allows an operator to move the power tool to a desired position in three-dimensional space where the power tool is to be used, the power tool being a tool that performs a job on being given a driving force, the power tool holding assembly comprising:

first direction guiding means for guiding movement of the power tool in a first direction and for holding the power tool stationary at a desired height due to pressure applied by a fluid that is introduced into the first direction guiding means from outside;

intersecting plane guiding means which is connected in series to the first direction guiding means and guides movement of the power tool in a plane that intersects the first direction; and power tool mounting means for mounting the power tool onto one of the first direction guiding means and the intersecting plane guiding means.

2. The power tool holding assembly of claim 1, wherein the first direction guiding means includes:

a moving member; and a guide member for guiding the moving member so as to move in the first direction.

3. The power tool holding assembly of claim 2, wherein the moving member is a rod that includes a piston part and the guide member is a cylinder provided around the piston part, and wherein a vent is provided at both an upper part and a lower part of the cylinder with an area inside the cylinder below the piston part being filled with fluid via the vent at the lower part of the cylinder.

4. The power tool holding assembly of claim 3, wherein the intersecting plane guiding means includes:

a first guiding part that guides a first movement of the power tool; and a second guiding part that guides a second movement of the power tool that differs from the first movement.

5. The power tool holding assembly of claim 4, wherein the first movement is a linear movement and the second movement is a circular movement.

6. The power tool holding assembly of claim 5, wherein the first guiding part is a ball spline and the second guiding part is a rotational holding part that holds the ball spline so as to allow rotation of the ball spline within the intersecting plane.

7. The power tool holding assembly of claim 6, wherein the first direction is substantially vertical and the intersecting plane is substantially horizontal.

8. The power tool holding assembly of claim 7, further comprising a securing member for securing a guiding means, out of the first direction guiding means and the intersecting plane guiding means, to which the power tool is not mounted to a solid object.

9. The power tool holding assembly of claim 1, wherein the intersecting plane guiding means includes:

a first guiding part that guides a first movement of the power tool; and a second guiding part that guides a second movement of the power tool that differs from the first movement.

10. The power tool holding assembly of claim 9, wherein the first movement is a linear movement and the second movement is a circular movement.

11. The power tool holding assembly of claim 10, wherein the first guiding part is a ball spline and the second guiding part is a rotational holding part that holds the ball spline so as to allow rotation of the ball spline within the intersecting plane.

12. The power tool holding assembly of claim 11, wherein the first direction guiding means includes:

a moving member; and a guide member for guiding the moving member so as to move in the first direction.

13. A power tool holding assembly that supports a power tool and allows an operator to move the power tool to a desired position in three-dimensional space where the power tool is to be used, the power tool being a tool that performs a job on being given a driving force, the power tool holding assembly comprising:

a first movement guiding member which has a moving end and guides movement of the moving end in a direction in which gravity acts;

a second movement guiding member which has a moving end and guides movement of the moving end in a plane that intersects the direction in which gravity acts;

a linking member for connecting a moving end of one guiding member, out of the first movement guiding member and the second movement guiding member, to another guiding member, out of the first movement guiding member and the second movement guiding member;

a power tool mounting member which is attached to the moving end of the other guiding member and sets the power tool onto the other guiding member; and load canceling means for applying lift to the first movement guiding member to counter a weight load applied by the moving end of the first movement guiding member and so keep the moving end of the first movement guiding member stationary at a desired position.

14. The power tool holding assembly of claim 13, wherein the first movement guiding member includes:

a rod including a piston part, wherein the moving end of the first movement guiding member is one end of the rod; and a cylinder which is provided around the piston part and has one air vent at each end, the load canceling means including:

compressed air generating means for introducing compressed air into an air vent, out of the air vents in the cylinder, at a lower position with respect to a direction in which gravity acts; and air pressure regulating means for regulating air pressure of the compressed air so that the rod becomes stationary at the desired position.

15. The power tool holding assembly of claim 13, further comprising a securing member for securing a guiding member, out of the first movement guiding member and the second movement guiding member, that is furthest from the power tool mounting member to a solid object.

* * * * *